United States Patent [19]

Kramer et al.

[11] Patent Number: 4,628,490

[45] Date of Patent: Dec. 9, 1986

[54] WIDEBAND SONAR ENERGY ABSORBER

[75] Inventors: Irvin R. Kramer, Baltimore; Wayne T. Reader, Mourovia, both of Md.

[73] Assignee: The United States of America as represented by the Secretary of the Navy, Washington, D.C.

[21] Appl. No.: 813,310

[22] Filed: Dec. 24, 1985

[51] Int. Cl.[4] ..... E04B 1/82

[52] U.S. Cl. ..... 367/1; 181/286

[58] Field of Search ..... 367/1; 181/284, 286, 181/290, 294

[56] References Cited

U.S. PATENT DOCUMENTS

| | | | |
|---|---|---|---|
| 3,515,910 | 6/1970 | Fritz et al. | 367/1 X |
| 3,614,992 | 10/1971 | Whitehouse et al. | 367/1 X |
| 3,894,169 | 7/1975 | Miller | 367/1 X |

*Primary Examiner*—Richard A. Farley

*Attorney, Agent, or Firm*—Luther A. Marsh

[57] ABSTRACT

This invention relates to an acoustic energy absorbing material which absorbs sound energy underwater and its performance is independent of the surrounding hydrostatic pressure. It consists of a non-conducting elastomeric matrix having piezoelectric or magnetostrictive particles disposed therein for converting incident soundwave energy into heat, a corrosion resistant coating on the particles for optimizing energy absorption of sonar waves of predetermined frequency, the elastomeric matrix designed so as to have a Poisson's ratio of about 0.5 for effectively utilizing all particles so the incident soundwaves are applied to the particles as a hydrostatic stress distribution, and the acoustic energy absorbing material consisting of a plurality of thin layers of the elastomeric matrix and having high energy absorption per unit volume for providing a slight impedance mismatch between successive layers thus absorbing the predetermined energy of the soundwaves.

6 Claims, 6 Drawing Figures

WIDEBAND SONAR ENERGY ABSORBER

STATEMENT OF GOVERNMENT INTEREST

The invention described herein may be manufactured and used by or for the government of the United States of America for governmental purposes without the payment of any royalties thereon or therefor.

BACKGROUND OF THE INVENTION

1. Field of the Invention

This invention relates to a means for reducing the sound energy which is reflected from or radiated by an underwater structure. More specifically, it relates to a means for absorbing sound energy in an elastomeric coating, which in addition to dissipating energy through hysteric mechanisms, makes use of the piezoelectric or magnetostrictive mechanism to convert sound energy to electric or magnetic energy which is then converted to heat by resistive elements, which may be either internal or external to the absorptive layer. Further, is relates to providing desired acoustic performance levels in a one or two decade frequency band with coatings which are one-half to one-third as thick as prior designs. It also provides acoustic performance insensitive to hydrostatic pressure variations of one decade or more.

2. Description of the Prior Art

The primary means currently for preventing the reflection and radiation of sound from underwater structures is through use of anechoic or antiradiative coatings constructed of viscoelastic rubbers which dissipate energy through hysteric losses. The coating is installed on the exterior of the structure thereby forming a layer between the surrounding water and the structure's outer surface. The coating design allows substantially matching the impedance of the structure presented to the waterborne sound wave to the characteristic impedance of water, $p_o C_o$ where $p_o$ is the density and $c_o$ is the sound speed of water, thus allowing the sound to pass directly into the coating without significant amounts of the energy being reflected. The longitudinal sound waves, after passing into the coating, are converted into shear deformations by air voids purposely formed in the rubber layer during its manufacture. The energy within the shear deformations is dissipated by the hysteric losses present in the properly formulated viscoelastic polymer. Other means for absorbing underwater sound energy is through use of piezoelectric or ferroelectric effect in single layer coatings as illustrated in U.S. Pat. Nos. 3,515,910 and 3,614,992.

SUMMARY OF THE INVENTION

The invention provides means for reducing the sound energy which is reflected from or radiated by an underwater structure. The invention is a means for absorbing sound energy in a very specific type of elastomeric coating, and, installed and utilized on the exterior of an underwater structure. Such a coating forms a layer between the surrounding water and the structure's outer surface. Such coating consists of a plurality of thin layers having high energy absorption per unit volume and provide a slight impedance mismatch between each successive layer thus absorbing the predetermined energy of the soundwaves.

The invention is an acoustic energy absorbing material means which comprises a non-conductive elastomeric matrix means having a plurality of piezoelectric or magnetostrictive particles disposed therein for converting incident soundwave energy into heat, a corrosion resistant means coated onto the particles for matching the properties of the piezoelectric or magnetostrictive particles for optimizing energy absorption of sonar waves of predetermined frequency, said elastomeric matrix means designed so as to have a Poisson's ratio of about 0.5 for effectively utilizing all the randomly oriented particles so that the incident soundwaves are applied to the particles as a hydrostatic stress distribution, and said elastomeric matrix means consisting of a plurality of thin layers having high energy absorption per unit volume for providing a slight impedance mismatch between successive layers thus absorbing the predetermined energy of the soundwaves.

OBJECTS OF THE INVENTION

Accordingly, an object of the invention is the more efficient conversion of acoustical energy to heat, thereby, significantly increasing the coating's capability to reduce reflected and radiated sound fields.

Another object of the invention is the provision that its performance is independent of the surrounding hydrostatic pressure.

Still another object of the invention is the provision that it provides a more efficient sound absorber and decreases the thickness required of a single layer to achieve good reductions by combining viscoelastic dissipative mechanisms with those utilizing the piezoelectric and magnetostrictive effects.

A further object of the invention is the provision of the use of a series of dissimilar layers so as to gradually change the complex acoustic impedance presented to the incident waterborne wave as it enters and is absorbed in the coating.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
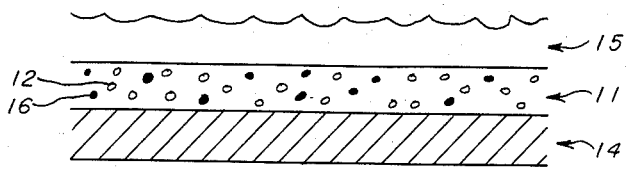
FIG. 1 is a sectional view of one embodiment of the wideband sonar energy absorber of the present invention.
Figure 2:
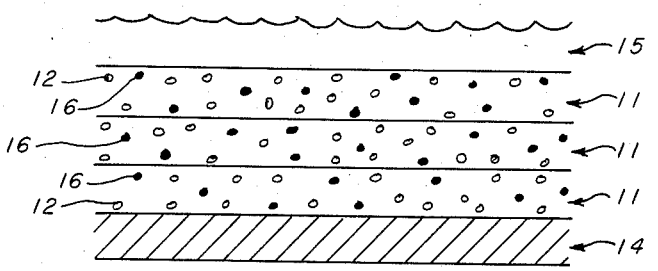
FIG. 2 is a sectional view of another embodiment of the wideband sonar energy absorber wherein multiple dissimilar layers of the type depicted in FIG. 1 are utilized in the present invention.
Figure 2A:
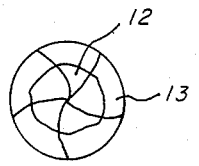
FIG. 2A is a coated particle.

Referring now to the drawings, wherein like reference numerals designate like or corresponding parts throughout the several views, FIG. 1, illustrates a preferred embodiment of the acoustic energy absorbing material means, wherein an elastomer layer 11 containing piezoelectric, ferroelectric or magnetostrictive particles 12, the elastomer layer 11 being attached to structure 14 submerged in water 15. Waterborne sound energy or structural vibrations generate stresses within elastomer layer 11, which when exerted upon particles 12, cause electric, if piezo- or ferro-electric or magnetic, if also specially formulated so as to exhibit hysteretic or viscoelastic losses and may also contain suitable fillers 16, illustrated in FIG. 2, such as graphite, so as to be partially conductive with the consequence that electric charges generated by the piezoelectric (ferroelectric) particles 12 or the magnetic fields generated by magnetostrictive particles 12 are dissipated as heat within the coating. Such a design absorbs incident waterborne sound or sound radiated from the structure by two mechanisms: (a)-by conversion of sound energy to heat by the viscoelastic effect and (b)-dissipation by conversion of the sound energy to electromagnetic energy which then converts to heat by finite internal resistance of elastomer layer 11. Particles 12, if not naturally piezoelectric, then must be initially polarized. FIG. 1, as depicted, consists of an elastomer layer 11 filled with solid particles 12 and is therefore totally void free; and, thus its performance is completely independent of the surrounding hydrostatic pressure. FIG. 2 illustrates the use of a series of dissimilar elastomer layers 11 as depicted in FIG. 1, allowing gradual change to the complex acoustic impedance presented to the incident waterborne wave sound as it enters and is absorbed in the coating. Each layer 11 may differ in thickness, the type of elastomer utilized and the number and distribution of particles 12 within each layer 11 is selected so as to maximize the sound energy absorbed by the coating. FIG. 2, while improving the absorptivity, the gradual transition utilized also serves to reduce sound radiated from structure 14 by blocking the transmission of sound from vibrating structures to water 15, as well as, by absorbing the sound as it passes through the coating.

Figure 3:
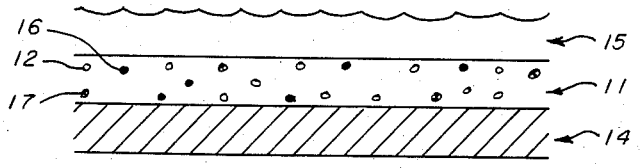
FIG. 3 is a sectional view of yet another embodiment utilizing microsphere of glass or plastic of the wideband sonar energy absorber of the present invention.
Figure 4:
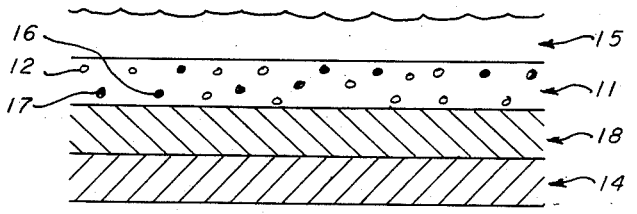
FIG. 4 is a sectional view of another embodiment utilizing a decoupling layer of the wideband sonar energy absorber of the present invention.

FIG. 3 illustrates in a sectional view, the use of hollow microspheres 17 in the fabrication of composite layers whose acoustical impedance is approximately equivalent to the characteristic of water, in order to decrease the composite layer's specific gravity. The microspheres may be of glass if the elastomer possesses a small shear modulus or if extremely high hydrostatic pressures are to encountered, and may be of a high grade plastic or other high grade flexible material if the base material's shear modulus is sufficiently great to resist the anticipated hydrostatic pressure. The flexible microspheres are advantageous in that they enhance the viscoelastic losses. The layers may be adhesively bonded together with the entire assembly being adhesively bonded to structure 14. Alternatively, the assembly could be bolted together as well as to structure 14.

FIG. 14 illustrates the use of decoupling layer 18 incorporated into the highly efficient combined anechoic and decoupling coating and is inserted between absorbing layer 11 and structure 14. Decoupling layer 18 is utilizable due to the high efficiencies obtained with these absorbing layers.

Figure 5:
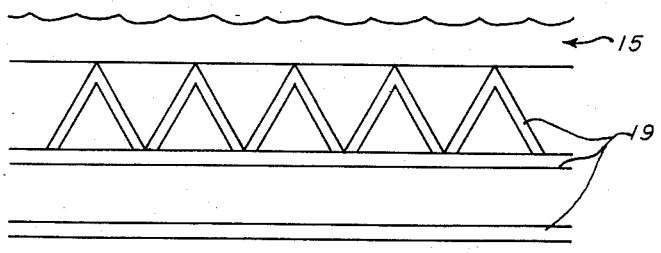
FIG. 5 is a sectional view of one embodiment utilizing conductive layers of similar or dissimilar characteristics so conformed to form wedges or pyramids of any desired cross section of the wideband sonar energy absorber of the present invention.

FIG. 5 illustrates a variant of the previous designs in which partial or entire conductive layers of similar or dissimilar characteristics are configured to form wedges or pyramids 19 of any desirable cross section. The space between the wedges may be filled with a fluid 15, such as the seawater surrounding the structure. Such space may also be filled with elastomer to obtain desired design acoustic results. Further, the wedges or pyramids may be fabricated of a material with uniform materials instead of discrete layers, thus assisting in obtaining the desired results.

The acoustic energy absorbing material of the invention comprises a non-conducting elastomeric matrix 11 with a plurality of piezoelectric or magnetostrictive particles 12 disposed therein for converting incident soundwave energy into heat. Surface particle coating 13 on the individual particles are matched with properties of the piezoelectric or magnetostrictive substances to optimize energy absorption of sonar waves of predetermined frequency. To effectively utilize all of the randomly oriented particles 12 the elastomer 11 is designed to have a Poisson's ratio of about 0.5 so that the incident soundwaves are applied to the particles as a hydrostatic stress distribution. The acoustic energy absorbing material then has a relatively high energy absorption per unit volume which permits use of a plurality of thin layers wherein a slight impedance mismatch occurs between successive layers to more efficiently absorb the soundwaves. To convert the sound energy to heat in an efficient manner it is preferable to coat the piezoelectric or magnetostrictive particles with a material 13, such as, silver that has excellent corrosion resistance to water especially seawater and to select the electrical resistance of the coating in terms of the piezoelectric or magnetostrictive particles. Such coating 13 on piezoelectric (ferroelectric) particles 12, such as, silver, aluminum, and nickel on their surfaces aid in polarization and to make intimate contact with the conducting elastomer.

Microspheres 17, such as, glass or plastic utilized in and discussed in FIG. 3 also may be coated with a conducting material such as silver 13 to improve or enhance the conductivity of the composite layer. These coated microspheres 17 are then used to control the conductivity of elastomeric layer 11, as well as, to decrease the density and to increase the viscoelastic losses. The metallic particles are a more common method used to increase the conductivity of normally non-conducting materials such as elastomers, but they add additional weight, thereby, increasing the specific gravity of the composite.

The adhesive used to bond the assembly to metallic structure 14 could be conducting, thus allowing structure 14 to serve as one electrode in the case where external resistance elements are utilized to dissipate the electro-magnetic fields. However, in this case conducting layers would be required between all layers as illustrated in FIGS. 1–4.

The maximum efficiency according to the invention is obtained when:

$$R=\tfrac{1}{2}\pi fc$$

where R=electrical resistance, f=frequency of impinging wave front, and c=capacitance. The power loss P under the condition will be:

$$P=\frac{V^2}{2R}$$

where V is the voltage generated by the piezoelectric or magnetostrictive particle. An example of the energy dissipated by a piezoelectric particle can be shown that for a particle a length in the direction of wave of l, t long and w wide, the power loss is:

$$P = \frac{\pi f \epsilon^2 ltw}{g_{33}^2 K \epsilon_o}$$

where $\epsilon$=strain, $g_{33}$=piezoelectric constant, $K\epsilon_o$=absolute dielectric constant. With a strain of $10^{-6}$, t=1 cm, w=1 cm, l=1 mm, f=1000 cycles per second and $g_{33}=25\times 10$, therefore $P=5.5\times 10$ watts/particle. Note, that in addition to the piezoelectric or magnetostrictive particles, the sonic energy is also absorbed by matrix material 11. The matrix material 11 is comprised of elastomeric material with appropriate addition of microsphers 17 of glass or plastic to adjust the density such that the p×C matches that of water (C=velocity of sound in the matrix). The amount of microspheres is adjusted to provide the necessary density gradient for the most efficient absorption and the least reflection of the sonic energy. The distribution of the piezoelectric or magnetostrictive particles is adjusted to obtain the maximum adsorption and the least sonic reflection. Accordingly, to keep the density fixed at a given level the increase in density due to the piezoelectric and magnetostrictive particles is balanced by the addition of the low density microspheres.

One primary advantage of the invention is the more efficient conversion of acoustical energy to heat, thereby, significantly increasing the coating's capability to reduce reflected and radiated sound fields. The increased efficiency is obtained by incorporating both viscoelastic losses and those depending upon piezoelectric (ferroelectric) or magnetostrictive effects into the same layer. This increased efficiency allows a given amount of energy to be dissipated in a thinner layer than heretofore possible and decreases the thickness of the coating required to reduce the reflections and radiations from the submerged structures.

Acoustic performance over wide frequency ranges of several decades or so according to this invention is obtained through the use of a variety of layers providing gradual changing impedance to the incident wave as it travels through the coating. The concept of gradual transition, that is, the gradual changing impedance to the incident wave as it travels through the coating reduces the thickness by one-half to one-third the thickness required of the heretofore single layers to give comparable acoustic performance.

Obviously many modifications and variations of the present invention are possible in the light of the above teachings. It is therefore to be understood that within the scope of the appended claims the invention may be practiced otherwise than as specifically described.

What is claimed is:

1. An acoustic energy absorbing material means comprising:

a non-conducting elastomeric matrix means having particles selected from the group consisting of piezoelectric and magnetostrictive material disposed therein for converting incident soundwave energy into heat, a corrosion resistant means coated onto the particles for matching the properties of the piezoelectric and magnetostrictive particles for optimizing energy absorption of sonar waves of predetermined frequency, said elastomeric matrix means designed so as to have a Poisson's ratio of about 0.5 for effectively utilizing all particles so the incident soundwaves are applied to the particles as a hydrostatic stress distribution, said acoustic energy absorbing material means consisting of a plurality of thin layers of the elastomeric matrix means and having high energy absorption per unit volume for providing a slight impedance mismatch between successive layers thus absorbing the predetermined energy of the soundwaves.

2. An acoustic energy absorbing material means as claimed in claim 1 wherein the particles are of any conducting metal.

3. An acoustic energy absorbing material means as claimed in claim 1 wherein the particles are randomly oriented in the elastomeric matrix.

4. An acoustic energy absorbing material means as claimed in claim 1 wherein the corrosion resistant means coated onto the piezoelectric and magnetostrictive particles for matching their properties for optimizing energy absorption of sonar waves of predetermined frequency is selected from the group consisting of silver, nickel, and chromium.

5. An acoustic energy absorbing material means as claimed in claim 1 wherein the non-conducting elastomer is selected from the group consisting of natural rubber, polymeric nitriles, polysulfides rubbers, or any other viscoelastic rubber.

6. An acoustic energy absorbing material means as claimed in claim 1 wherein the elastomeric matrix means is void free and its performance is independent of the surrounding hydrostatic pressure.

* * * * *